US007554050B1

(12) United States Patent
Lv

(10) Patent No.: US 7,554,050 B1
(45) Date of Patent: Jun. 30, 2009

(54) ROCKING KEY BUTTON ASSEMBLY AND ELECTRONIC DEVICE USING THE SAME

(75) Inventor: Yue-Hui Lv, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 12/233,758

(22) Filed: Sep. 19, 2008

(30) Foreign Application Priority Data

Jun. 23, 2008 (CN) ..... 2008 1 0302273

(51) Int. Cl.
*H01H 23/00* (2006.01)

(52) U.S. Cl. ..... 200/339; 200/553; 200/343

(58) Field of Classification Search ..... 200/553, 200/557, 558, 296, 329, 517, 339, 341, 343; 341/20, 22, 35; 345/156, 168, 169, 184
See application file for complete search history.

(56) References Cited

U.S. PATENT DOCUMENTS 4,045,650 A * 8/1977 Nestor ..... 200/556
5,508,479 A * 4/1996 Schooley ..... 200/5 R
5,934,453 A * 8/1999 Sugawara et al. ..... 200/339
6,114,637 A * 9/2000 Nakao et al. ..... 200/5 R
6,239,726 B1 * 5/2001 Saida ..... 340/999
6,617,535 B2 * 9/2003 Lacroix ..... 200/339
7,094,983 B2 * 8/2006 Tsunemoto ..... 200/339
7,138,583 B2 * 11/2006 Wallace ..... 174/260
7,217,898 B2 * 5/2007 Chien et al. ..... 200/339
7,285,740 B2 * 10/2007 Nakajima ..... 200/339
7,426,338 B2 * 9/2008 Matsumoto et al. ..... 396/25

* cited by examiner

*Primary Examiner*—Michael A Friedhofer
(74) *Attorney, Agent, or Firm*—Steven M. Reiss

(57) ABSTRACT

An electronic device (20) includes a housing (24) and a rocking key button assembly (200) rockingly assembled to the housing. The housing includes a shaft portion (264) and a blocking board (268). The key button assembly includes a key button (30) having two opposite key portions (312), two elastic retaining members (40), two elastic arms (50) and two triggers (60). The elastic retaining members are retained to the shaft portion. The elastic arms resist against the blocking board. The key portions can rock relative to each other and about the shaft portion, the corresponding one trigger swings relative to the other trigger and about the shaft portion. The corresponding elastic arm is compressed by the blocking board. The elastic retaining members, the elastic arms and the triggers are arranged at the same side of the key button opposite to the two keys.

13 Claims, 4 Drawing Sheets

ROCKING KEY BUTTON ASSEMBLY AND ELECTRONIC DEVICE USING THE SAME

BACKGROUND

1. Field of the Invention

The invention relates to a rocking key button assembly used in an electronic device.

2. Description of Related Art

With rapid development of information technology, electronic devices, such as cellular phones, personal digital assistant (PDA), and so on, are become more and more popular. For general electronic devices, key buttons mechanisms may be arranged on two side surfaces of the electronic devices to provide command shortcuts. For example, key button mechanisms can be used for receiving a call or adjusting sound volume.

Key button assemblies, especially rocking assemblies, can be difficult to assemble. Take a rocking key button assembly (including a key button and two holding members) for example. The holding members retain the key button within a housing of the electronic device. The key button has two shafts fixed to the housing. The key button rotates about the shafts and thus rocks relative to the housing. Assembly can be difficult due to the structure of the key button assembly and the relationship of the key button assembly with the housing.

Therefore, there is room for improvement within the art.

BRIEF DESCRIPTION OF THE DRAWINGS

Many aspects of the exemplary rocking key button assembly and an exemplary electronic device using the rocking key button assembly can be better understood with reference to the following drawings. These drawings are not necessarily drawn to scale, the emphasis instead being placed upon clearly illustrating the principles of the exemplary rocking key button assembly and the electronic device. Moreover, in the drawings like reference numerals designate corresponding parts throughout the several views. Wherever possible, the same reference numbers are used throughout the drawings to refer to the same or like elements of an embodiment.

DETAILED DESCRIPTION OF THE EXEMPLARY EMBODIMENTS

Figure 1:
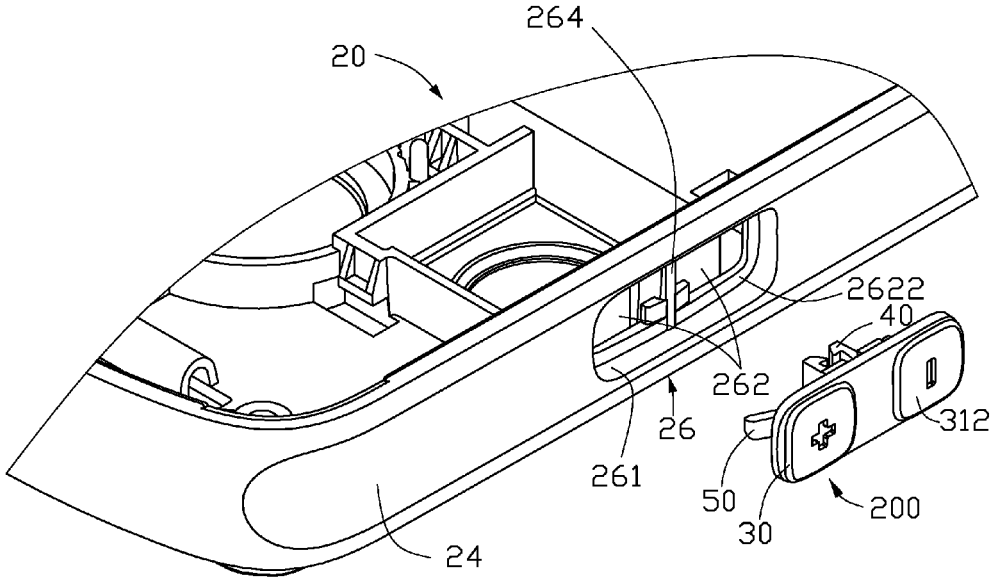
FIG. 1 is an isometric and partial view of an electronic device using a rocking key button assembly according to the exemplary embodiment.
Figure 2:
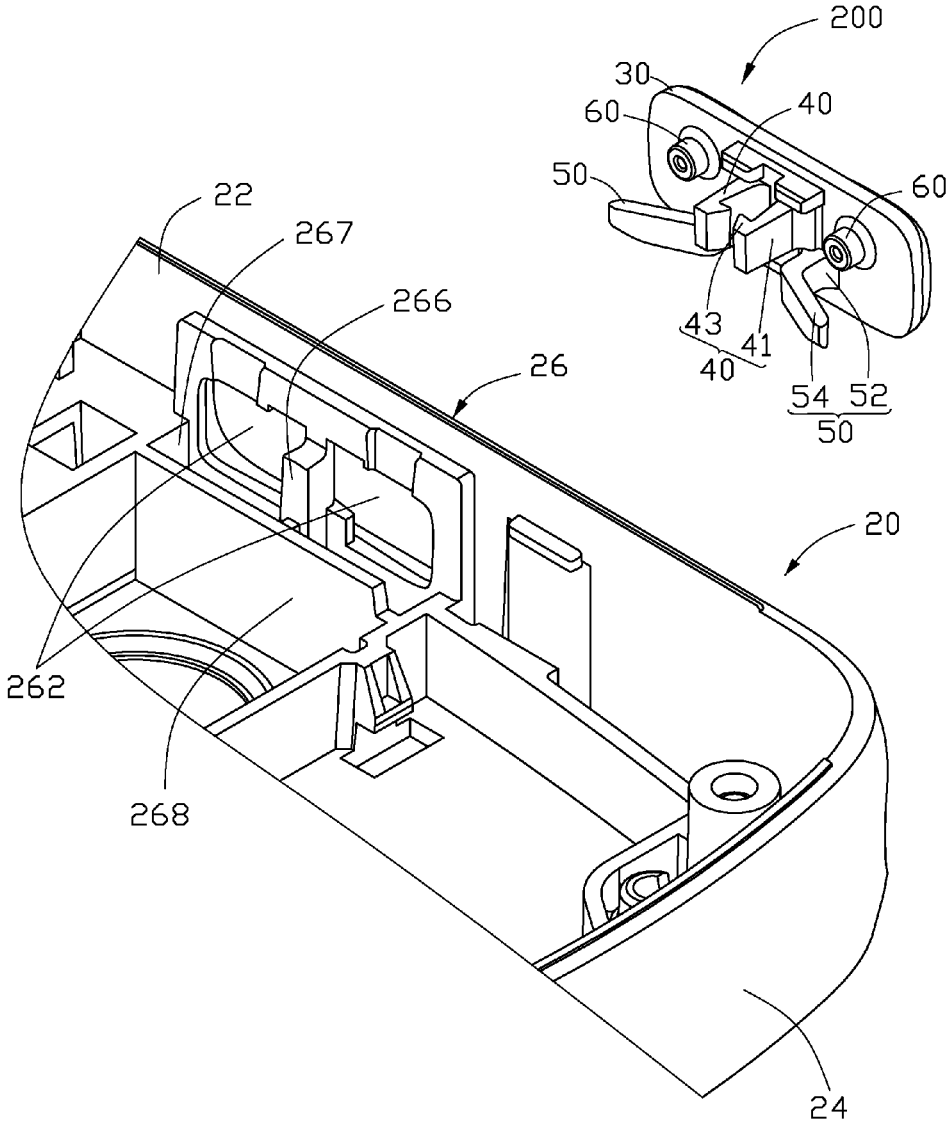
FIG. 2 is another view of the electronic device shown in FIG. 1 from a different angle.

FIG. 1 shows an exemplary rocking key button assembly 200 used in an exemplary electronic device 20, such as cellular phone. The electronic device 20 includes a housing 24 and at least two circuit loops (not shown). One circuit loop can be for increasing volume. The other circuit loop can be for decreasing volume.

Housing 24 defines a mounting area 26 at which the rocking key button assembly 200 is mounted. The mounting area 26 defines a receiving groove 261 and two mounting holes 262, a shaft portion 264, a retaining portion 266, and a blocking board 268. The receiving groove 261 surrounds the two mounting holes 262, which are exposed to the inside of the housing 24. The two mounting holes 262 are separated from each other by the shaft portion 264. The shaft portion 264 faces the receiving groove 261. The retaining portion 266 faces the inside of the housing 24. Since the receiving groove 261 is larger than the mounting holes 262, a stepped wall 2622 surrounds the receiving groove 261 and the mounting holes 262. The housing 24 defines an accommodating space 267 between the blocking board 268 and the retaining portion 266.

The rocking key button assembly 200 is configured to be mounted in the mounting area 26 and can rock relative to the housing 24. The rocking key button assembly 200 includes a key button 30, two elastic retaining members 40, two elastic arms 50, and two triggers 60. The key button 30, the elastic retaining members 40, the elastic arms 50, and the triggers 60 are integrally formed, e.g., by co-molding.

The key button 30 is configured to be received and secured in the receiving groove 261 and includes two opposite key portions 312, marked with, for example, "+" and "−", respectively. The key portion 312 marked with "+" can be identified and used to increase the volume. The key portion 312 marked with "−" can be identified and used to decrease the volume.

The two elastic retaining members 40 extend from an interior surface of the key button 30. The two elastic retaining members 40 include two connecting arms 41 and two retaining hooks 43. The connecting arms 41 connect the retaining hooks 43 to the interior surface of the key button 30. The retaining hooks 43 extend from the connecting arms 41 and towards each other. The elastic retaining members 40 are configured to be deformably inserted through the mounting holes 262 and retained in the accommodating space 267 by the retaining hooks 43 retaining the retaining portion 266 (best seen in FIG. 4).

The elastic arms 50 are symmetrically arranged on the interior of the key button 30. The elastic arms 50 include two connecting portions 52 and two resisting portions 54. The connecting portions 52 connect the resisting portions 54 to the interior surface of the key button 30. The retaining portions 54 extend from the connecting portions 52 and away from each other. The angle of each retaining portion 54 and a corresponding connecting portion 52 is from >90 degrees to <180 degrees and excludes 90 degree and 180 degree. The triggers 60 are arranged on a surface of the key button 30 and at two sides of the retaining members 40. The triggers 60 can be generally cylindrical.

Figure 3:
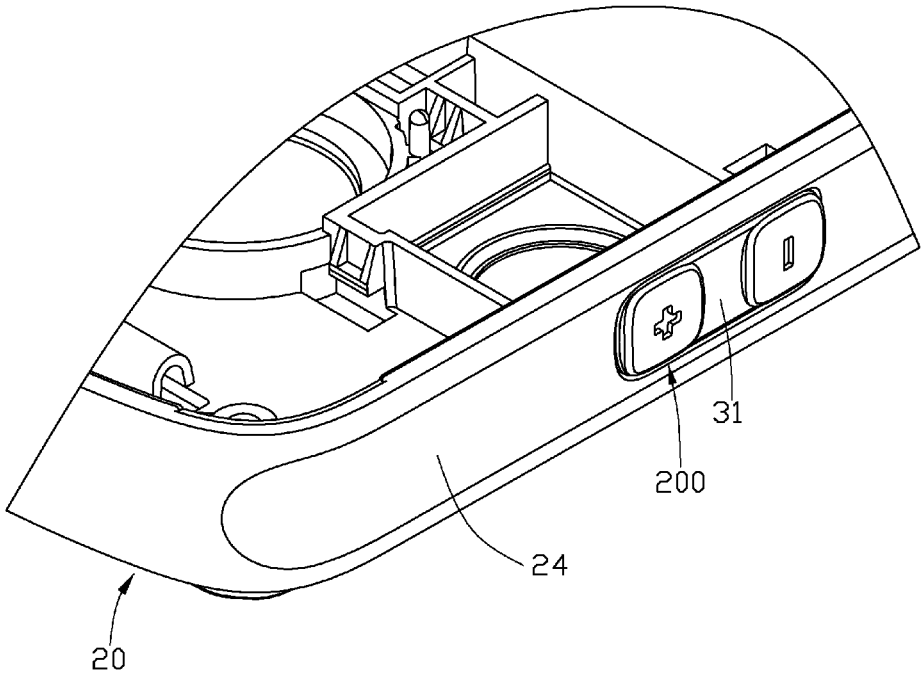
FIG. 3 is an assembled view of the rocking key button assembly and a housing shown in FIG. 1.
Figure 4:
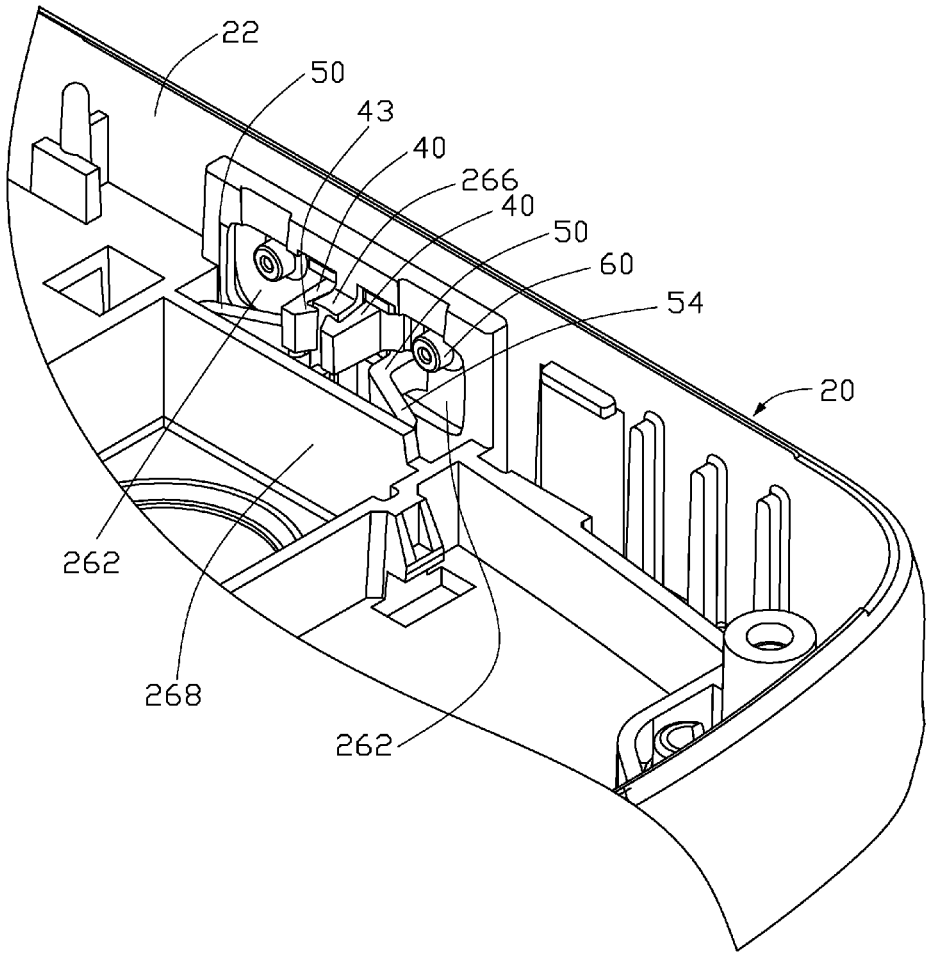
FIG. 4 is another assembled view of the rocking key button assembly to and a housing shown in FIG. 1. from a different angle.

Referring to FIGS. 3 and 4, the rocking key button assembly 200 is assembled to the electronic device 20. The rocking key button assembly 200 is rockingly secured within the housing 24. The key button 30 is received in the receiving groove 261 and has a clearance relative to the stepped wall 2622. The retaining hooks 43 retain the retaining portion 266 between the retaining hooks 43. The elastic arms 50 are accommodated in the accommodating space 267 and elastically compressed by the blocking board 268. The triggers 60 are received within the housing 24 and positioned corresponding to two triggering points (not shown) of the circuit loops.

The electronic device 20's volume can be adjusted by using the key button mechanism 200. In case of the volume being increased, the key portion 312 marked with "+" is pressed into the housing 24. Correspondingly, the retaining members 40 retained by the retaining portion 266 may be deformed to swing around the shaft portion 264. The key button 30 swings along with the retaining members 40 to reach towards the stepped wall 2622. During this stage, the trigger 60 moves to contact the triggering point. Thus, the circuit loop works to increase the volume. The key button 30, the trigger 60 and the retaining members 40 can return their original state by removing the pressing force.

It is to be understood, however, that even through numerous characteristics and advantages of the exemplary invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A rocking key button assembly for an electronic device, comprising:

a key button comprising two opposite key portions;

two elastic retaining members;

two elastic arms; and two triggers corresponding to the two keys and the two elastic arms, such that when the key portions rocks relative to each other, a corresponding trigger swings relative to the other trigger, and the corresponding elastic arm is compressed;

wherein the elastic retaining members, the elastic arms and the triggers are arranged on the same surface of the key button.

2. The rocking key button assembly as claimed in claim 1, wherein the keys swing around the two elastic retaining members.

3. The rocking key button assembly as claimed in claim 2, wherein the two elastic retaining members are located between the two triggers and includes two connecting arms and two retaining hooks, the connecting arms connecting the retaining hooks to the key button, the retaining hooks extending from the connecting arms and towards with each other.

4. The rocking key button assembly as claimed in claim 2, wherein the two elastic arms comprise two connecting portions and two resisting portions, the connecting portions connect the resisting portions to the key button, the retaining portions extending from the connecting portions and oppositely from each other.

5. The rocking key button assembly as claimed in claim 4, wherein the angle of each retaining portion and the corresponding connecting portion is ranged from >90 degree to <180 degree.

6. An electronic device, comprising:

a housing comprising a shaft portion, a blocking board;

a rocking key button assembly rockingly assembled to the housing, comprising:

a key button comprising two opposite key portions;

two elastic retaining members retained around the shaft portion;

two elastic arms resisting against the blocking board; and two triggers corresponding to the two keys and the two elastic arms such that when the key portions rock relative to each other and about the shaft portion, a corresponding trigger swings relative to the other trigger and about the shaft portion, and a corresponding elastic arm is compressed by the blocking board;

wherein the elastic retaining members, the elastic arms and the triggers are arranged on the same surface of the key button.

7. The electronic device as claimed in claim 6, wherein the housing defines a receiving groove and two mounting holes communicating with the receiving groove, the receiving groove rockable receiving the key button, the two mounting holes facilitating the key button assembly being assembled to the housing.

8. The electronic device as claimed in claim 7, wherein the two mounting holes are separated by the shaft portion, the shaft portion extending a retaining portion.

9. The electronic device as claimed in claim 8, wherein:

the two elastic retaining members include two connecting arms and two retaining hooks, the connecting arms connecting the retaining hooks to the key button, the retaining hooks extending toward with each other;

the retaining hooks retaining with the retaining portion; and the retaining members can be elastically deformed to swing about the shaft portion during swing of the keys.

10. The electronic device as claimed in claim 6, wherein the two elastic arms comprise two connecting portions and two resisting portions, the connecting portions connect the resisting portions to the key button, the retaining portions extending oppositely from each other.

11. The electronic device as claimed in claim 10, wherein the angle of each retaining portion and the corresponding connecting portion is ranged from >90 degree to <180 degree.

12. The electronic device as claimed in claim 10, wherein the retaining portions deformably resist against and compressed by the blocking board.

13. The electronic device as claimed in claim 10, wherein the elastic retaining members, the elastic arms and the triggers are integrally formed with the key button.

* * * * *